US005235805A

United States Patent [19]

Barbier et al.

[11] Patent Number: 5,235,805

[45] Date of Patent: Aug. 17, 1993

[54] GAS TURBINE ENGINE COMBUSTION CHAMBER WITH OXIDIZER INTAKE FLOW CONTROL

[75] Inventors: Gérard Y. G. Barbier, Morangis; Xavier M. H. Bardey, Chartrettes; Michel A. A. Desaulty, Vert Saint Denis; Serge M. Meunier, Le Chatelet en Brie, all of France

[73] Assignee: Societe Nationale d'Etude et de Construction de Moteurs d'Aviation "S.N.E.C.M.A.", Valin, France

[21] Appl. No.: 851,167

[22] Filed: Mar. 12, 1992

[30] Foreign Application Priority Data

Mar. 20, 1991 [FR] France ..... 91 03374

[51] Int. Cl.[5] ..... F23R 3/22

[52] U.S. Cl. ..... 60/39.23; 60/759

[58] Field of Search ..... 60/39.2, 39.24, 752, 60/757, 759, 760, 758; 431/352

[56] References Cited

U.S. PATENT DOCUMENTS

| | | | |
|---|---|---|---|
| 3,099,134 | 7/1963 | Calder et al. | 60/752 |
| 3,280,555 | 10/1966 | Charpentier et al. | 60/39.23 |
| 3,490,230 | 1/1970 | Pillsbury et al. | 60/39.23 |
| 3,593,518 | 7/1971 | Gerrard | 60/752 |
| 3,958,413 | 5/1976 | Cornelius et al. | 60/39.23 |
| 4,050,240 | 9/1977 | Vaught | 60/39.23 |

FOREIGN PATENT DOCUMENTS

| | | | |
|---|---|---|---|
| 0150432 | 6/1988 | Japan | 60/39.23 |
| 985058 | 3/1965 | United Kingdom | 60/752 |
| 1239559 | 7/1971 | United Kingdom | 60/752 |

*Primary Examiner*—Richard A. Bertsch
*Assistant Examiner*—Timothy S. Thorpe
*Attorney, Agent, or Firm*—Bacon & Thomas

[57] ABSTRACT

An oxidizer intake flow control system is disclosed for a gas turbine engine combustion chamber. The chamber has an oxidizer intake assembly which extends through the wall of the chamber such that an inlet aperture of the oxidizer intake and an exhaust aperture of the oxidizer intake are located on opposite sides of the wall defining the combustion chamber. An oxidizer intake sleeve defines a central passage through which oxidizer may pass into the combustion chamber. The intake passage extends along a central axis and the intake assembly is attached to the wall of the combustion chamber such that it is rotatable about this central axis. The inlet aperture and/or the exhaust aperture is located in a plane extending non-perpendicularly to the central axis. The combustion chamber may have several oxidizer intake assemblies extending through the combustion chamber walls. The intake assemblies may be interconnected such that they may be simultaneously rotated with respect to the combustion chamber wall.

15 Claims, 3 Drawing Sheets

GAS TURBINE ENGINE COMBUSTION CHAMBER WITH OXIDIZER INTAKE FLOW CONTROL

BACKGROUND OF THE INVENTION

Modern gas turbine engines are designed to operate under condition from idle to full load. In order for the engines to operate efficiently under these varying conditions, it is necessary to control the intake flow of oxidizer into the combustion chamber of the gas turbine engine. Several variations of oxidizer flow controls are described in French Patent 2,028,599.

SUMMARY OF THE INVENTION

The present invention relates to an oxidizer intake flow control system for a gas turbine engine combustion chamber. The chamber has an oxidizer intake assembly which extends through the wall of the chamber such that an inlet aperture of the oxidizer intake and an exhaust aperture of the oxidizer intake are located on opposite sides of the wall defining the combustion chamber. An oxidizer intake sleeve defines a central passage through which oxidizer may pass into the combustion chamber. The intake passage extends along a central axis and the intake assembly is attached to the wall of the combustion chamber such that it may rotate about this central axis. The inlet aperture and/or the exhaust aperture is located in a plane extending non-perpendicularly to the central axis.

The combustion chamber may have several of these oxidizer intake assemblies extending through the combustion chamber walls. The intake assemblies may be interconnected such that they may be simultaneously rotated with respect to the combustion chamber wall.

The combustion chamber of the gas turbine engine is bounded by walls and may assume a generally annular configuration about a central axis of the gas turbine engine. In known fashion, fuel and oxidizer are mixed in the combustion chamber and ignited. A housing may extend around the combustion chamber such that a peripheral chamber is defined between the wall of the combustion chamber and the housing. Oxidizer entering this peripheral chamber may then pass through the oxidizer intake assemblies into the interior of the combustion chamber.

The oxidizer intake assembly may also have a diaphragm member to control the opening of the inlet aperture so as to control the oxidizer flowing through the intake assembly into the combustion chamber. The diaphragm member may be attached to the oxidizer intake sleeve so as to rotate with respect thereto. Control means are provided to rotate the diaphragm member with respect to the intake sleeve to accurately control the opening of the inlet aperture.

The oxidizer intake sleeve may be rotated with respect to the combustion chamber wall in order to control the direction in which the oxidizer passing through the central passage enters the combustion chamber. This direction is controlled by the orientation of the plane of the exhaust aperture and/or the plane of the inlet aperture.

The main advantage of the invention is in controlling the oxidizer flow through the orifices of the flame tube of the combustion chamber as a function of the particular operating conditions under which the gas turbine engine operates. The oxidizer flow is controlled by the position of the oxidizer intake assemblies to offer the maximum engine performance for a given operating condition. By adjusting the oxidizer flow into the combustion chamber, the fuel/oxidizer mixture richness and the dwell time in the primary combustion zone may be controlled to closely approach the optimum operational parameters under all engine operating conditions.

DETAILED DESCRIPTION OF THE PREFERRED EMBODIMENTS

Figure 1:
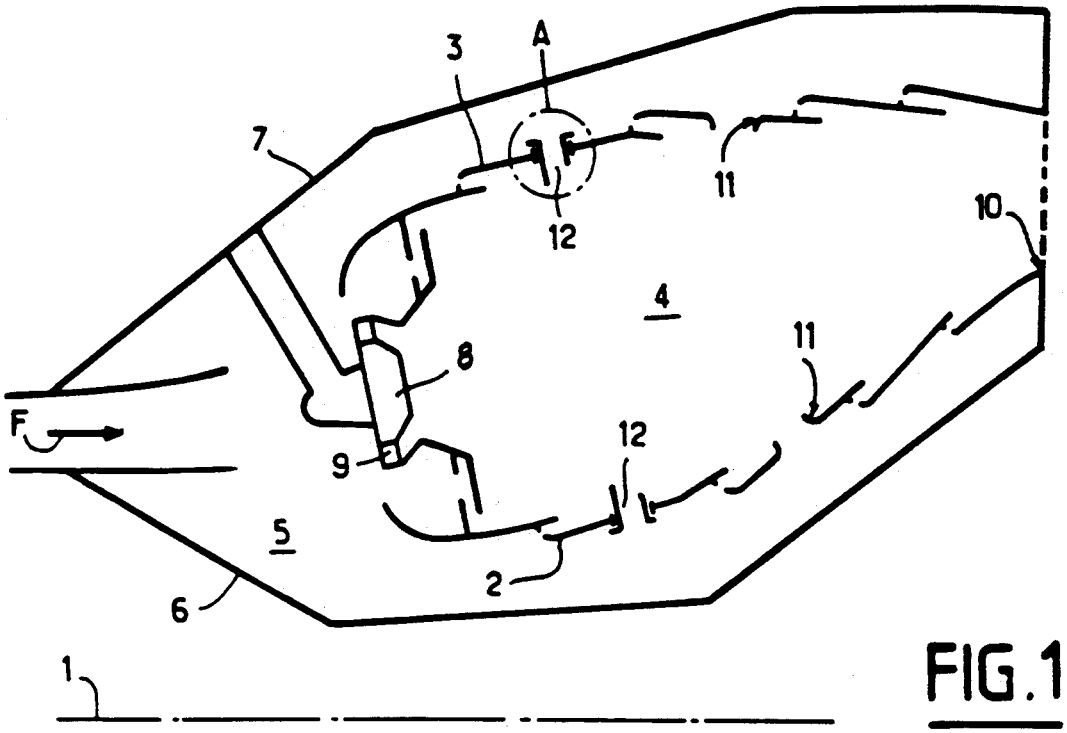
FIG. 1 is a partial, schematic longitudinal cross-sectional view of a combustion chamber according to the present invention.

A gas turbine engine combustion chamber is illustrated in cross-section in FIG. 1. Although the invention will be described in conjunction with this combustion chamber which is annular in shape and extends about a central axis 1 of the gas turbine engine (not shown) it is to be understood that the invention can be utilized with combustion chambers having other configurations.

The combustion chamber is bounded by inner wall 2 and outer wall 3 which together defines the combustion chamber 4. A housing comprising interior wall 6 and exterior wall 7 encloses the combustion chamber walls 2 and 3 such that a peripheral chamber 5 is defined between the housing and the combustion chamber walls.

The combustion chamber 4 is provided, in known fashion, with a fuel injector 8 and a primary oxidizer intake orifice 9 at its upstream end, and with an exhaust orifice 10 at its downstream end. During operation of the gas turbine engine, oxidizer enters the peripheral chamber 5 in the direction of arrow F. Typically, the oxidizer is air and is taken from a stage of an air compressor (not shown) located upstream of the combustion chamber. The oxidizer passing through the primary oxidizer intake orifice 9 is mixed with the fuel injected through fuel injector 8 within the combustion chamber 4.

Inner and outer walls 2 and 3 define a plurality of oxidizer intake orifices 11 allowing additional oxidizer to pass from the peripheral chamber 5 into the combustion chamber 4 to provide secondary or dilution oxidizer.

Additional oxidizer intake passages 12 also extend through inner and outer walls 2 and 3 so as to further allow passage of oxidizer from the peripheral chamber 5 into the combustion chamber 4. The oxidizer intake assemblies which define passage 12 are shown in more detail in FIGS. 2 and 3. The oxidizer intake assemblies extend through apertures 13 defined by at least one of the inner and outer walls 2 and 3. A sleeve member 14 defines the oxidizer intake passage 12 which extends along central axis 16. In the embodiment shown in FIGS. 2 and 3, the sleeve member 14 has a radially extending flange 15 which extends outwardly generally perpendicular to the central axis 16. The sleeve member 14 defines an inlet aperture 26 which communicates with the intake passage 12 and an exhaust aperture 36 which also communicates with the intake passage 12. In this embodiment, the exhaust aperture 36 lies in a plane P which extends obliquely to central axis 16 such that sleeve member 14 has an elongated side 17.

Figure 2:
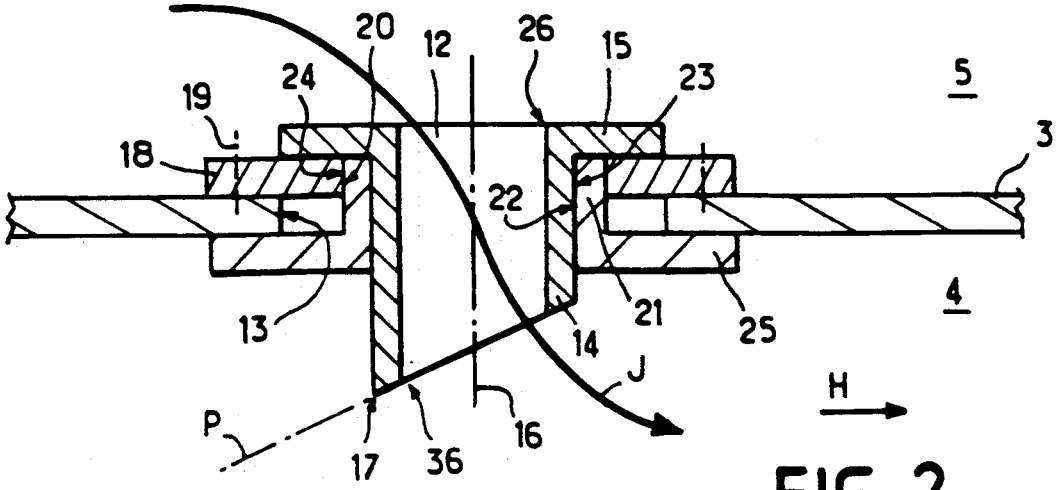
FIG. 2 is a partial, enlarged, cross-sectional view of an oxidizer intake assembly according to the present invention.
Figure 3:
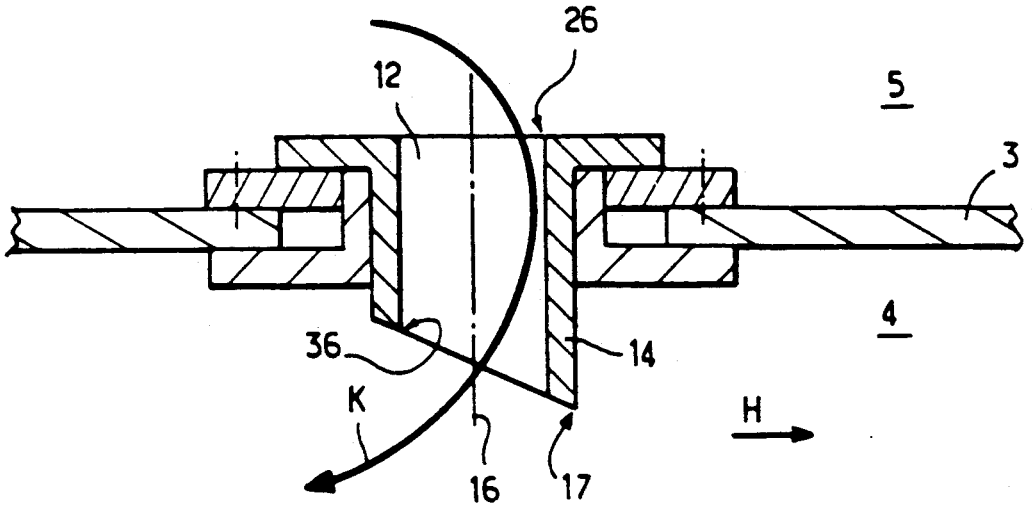
FIG. 3 is a view similar to FIG. 2 showing the oxidizer intake assembly rotated to a different position.

The sleeve member 14 is rotatably attached to the combustion chamber wall, here outer wall 3, so as to rotate with respect to the wall 3 about central axis 16. This attachment is accomplished by a disc member 18, which is generally annular in configuration having inner surface 24, being fixedly attached to wall 3 via screws 19, or the like. One side of disc member 18 slidably contacts one side of the flange 15 extending from the sleeve member 14. A collar member 21 having an inner annular surface 22 is fixedly attached to the outer surface 23 of the sleeve member 14. Collar member 21 has a flange 25 extending therefrom which slidably contacts the wall 3 of the combustion chamber. As can be seen in FIGS. 2 and 3, flange 25 slidably contacts an opposite side of the wall 3 from the disc member 18.

The sleeve member 14 and the collar member 21 are rotatably mounted, without any substantial clearance between the collar member 21 and the inner surface 24 of the disc member 18, such that the sleeve member 14 and the collar member 21 may rotate with respect to the disc member 18. Once the disc member 18 is fixedly attached to the wall of the combustion chamber, these elements (sleeve member 14 and collar member 21) may rotate with respect to the wall of the combustion chamber.

When the sleeve member 14 is in the position illustrated in FIG. 2, the elongated side 17 faces in an upstream direction of the combustion chamber. The gases within the combustion chamber travel in an upstream to downstream direction, indicated by arrow H in FIGS. 2 and 3. The oxidizer passing from the peripheral chamber 5, through the inlet passage 12 when the sleeve member 14 is in the position illustrated in FIG. 2 passes substantially in the direction of arrow J. Thus, the oxidizer enters the combustion chamber 4 traveling in substantially the same direction as the gases within the combustion chamber.

When the sleeve member 14 is rotated 180° into the position illustrated in FIG. 3, the combustion gases within the combustion chamber still travel in the direction illustrated by arrow H. However, the oxidizer passing through the inlet passage 12 now travels in the direction of arrow K due to the orientation of the exhaust aperture 36. In this position, the dwell time of the oxidizer within the combustion chamber 4 is maximized. The dwell time of the oxidizer within the combustion chamber 4 is minimized when the sleeve member 14 is oriented in the position illustrated in FIG. 2.

Figure 4:
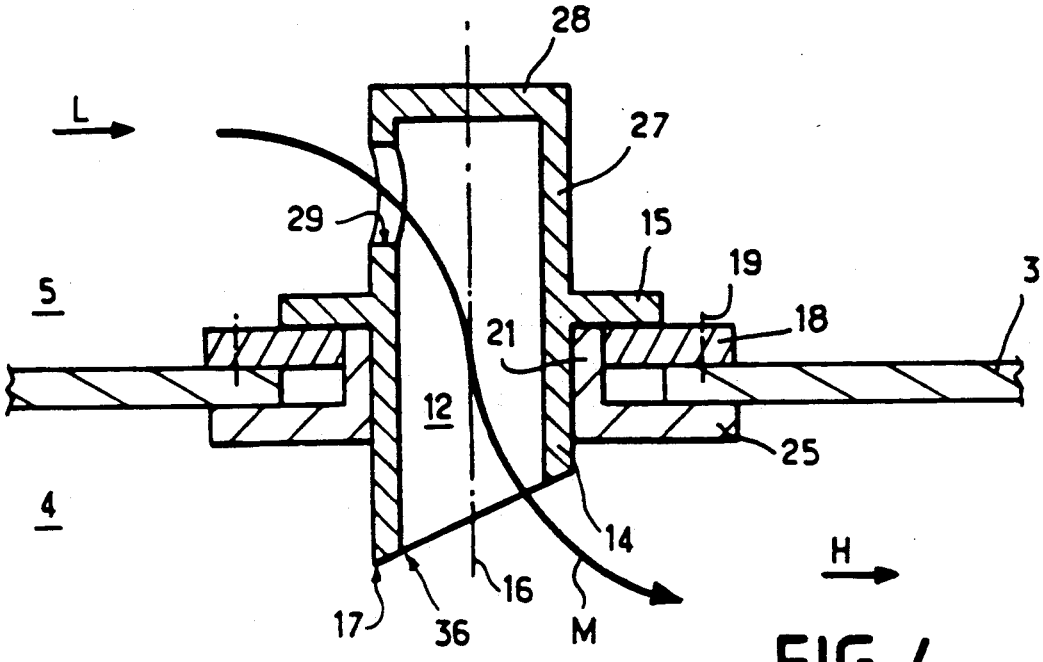
FIG. 4 is a partial, enlarged, cross-sectional of a second embodiment of the oxidizer intake assembly according to the present invention.
Figure 5:
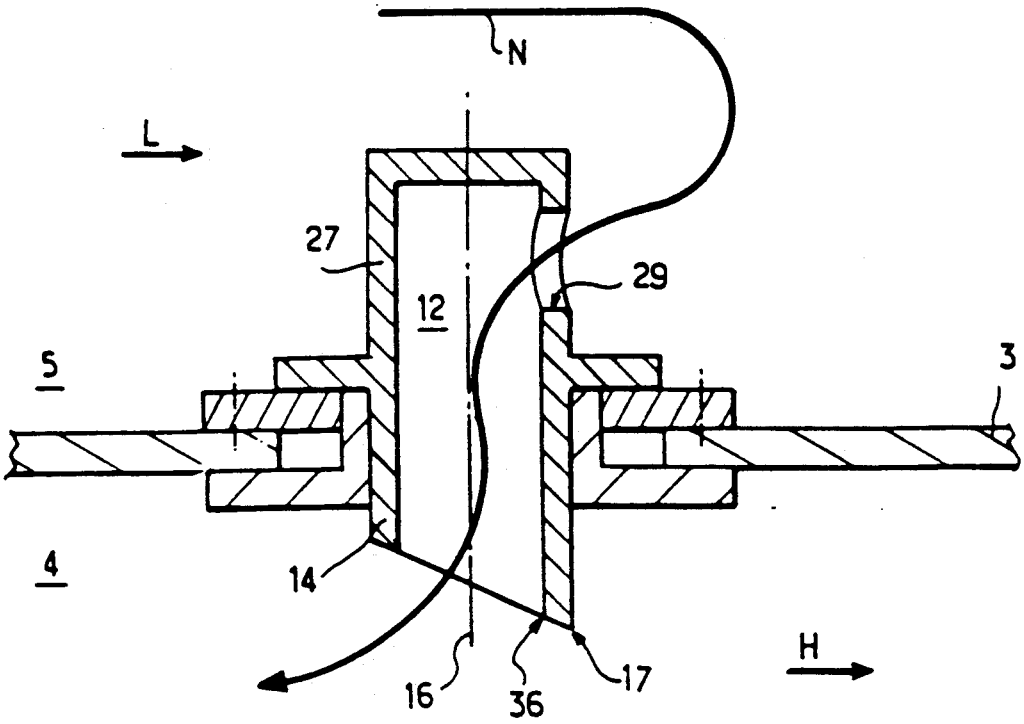
FIG. 5 is a view similar to FIG. 4 showing the oxidizer intake assembly of FIG. 4 rotated to a different position.

A second embodiment of the oxidizer intake assembly is illustrated in FIGS. 4 and 5. The sleeve member 14, the intake passage 12, the central axis 16 and the exhaust aperture 36 are the same as the embodiment previously described and illustrated in FIGS. 2 and 3. Similarly, the collar member 21 and the disc member 18 are configured and operate the same as in the previously described embodiment.

However, in this embodiment, the sleeve member 14 has a sleeve extension 27 extending beyond the flange 15 and an end wall 28 to close off the end of the intake passage 12. The sleeve extension 27 defines the intake aperture 29 such that this aperture lies in a plane extending generally parallel to the central axis 16. The inlet aperture 29 communicates with the intake passage 12.

In this embodiment, when the sleeve member 14 is oriented as illustrated in FIG. 4, the oxidizer travels through peripheral chamber 5 in the direction of arrow L and passes through the oxidizer intake assembly in the general direction of arrow M.

When the sleeve member 14 is rotated 180°, as illustrated in FIG. 5, the oxidizer passes through the peripheral chamber 5 in the direction of arrow L and is now forced to travel in the direction of arrow N in order to enter the combustion chamber. In this orientation, the inlet aperture 29 faces in a downstream direction relative to the flow of oxidizer through the peripheral chamber 5. The oxidizer then enters the combustion chamber generally counter to the flow of gases through the combustion chamber 4 which are traveling in the direction of arrow H.

In this embodiment, the elongated side 17 of the sleeve member 14 is generally on the same side of the sleeve member and is the inlet aperture 29. As a variation of this embodiment, inlet aperture 29 may be located on a side of the sleeve member 4 opposite from that of the elongated side 17.

Figure 6:
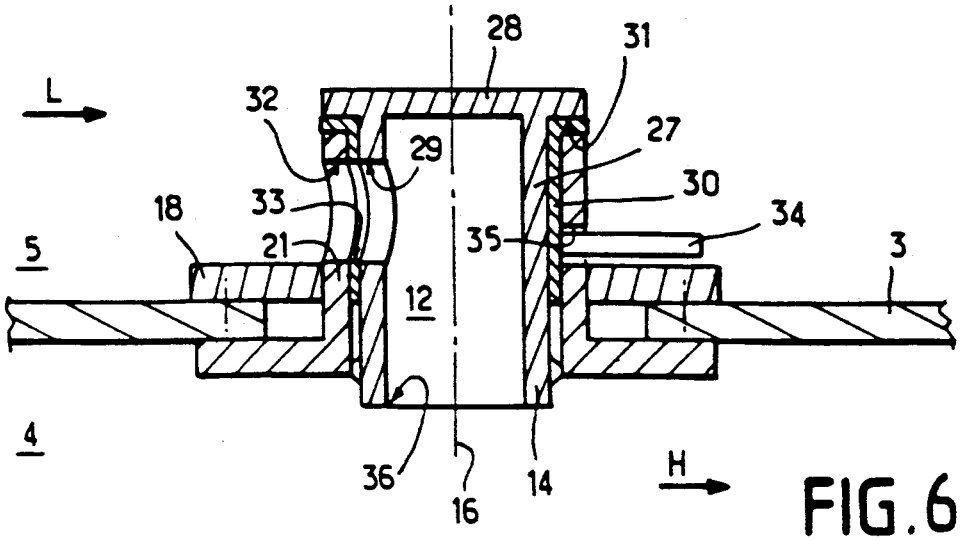
FIG. 6 is a partial, enlarged, cross-section of a third embodiment of the oxidizer intake assembly according to the present invention.

The embodiment of the oxidizer intake assembly illustrated in FIGS. 4 and 5 may be further modified to include a diaphragm member in order to control the opening of the inlet aperture 29. As illustrated in FIG. 6, the collar member 21 is modified to extend generally to the end 28 of the sleeve member 14. The collar 21 member defines an orifice 32 which is an alignment with the inlet aperture 29. A diaphragm member 30 is slidably interposed between the collar 21 and the wall 27 of sleeve member 14 and defines a control orifice 33. The diaphragm member 30 may rotate relative to the collar member 21 and the sleeve member 14, such that the orifice 33 may be moved out of alignment with the apertures 32 and 29 so as to prevent any oxidizer from flowing into the intake passage 12.

Diaphragm member 30 may be rotated by lever 34 which is fixedly attached to the diaphragm member 30 and which extends outwardly through a slot 35 formed in the collar member 21. In this manner, the oxidizer passing into the intake passage 12 may be regulated. Although the sleeve member 14 as illustrated in FIG. 6 has an exhaust aperture 36 extending generally perpendicular to the central axis 16, it is to be understood that the exhaust passage 36 could be oriented obliquely, as in the embodiments illustrated in FIGS. 2-5.

The sleeve members 14 may be mechanically linked, such as by individual gear rack systems, to a single drive motor such that they are simultaneously rotated with respect to the combustion chamber walls. A single drive motor may be utilized to simultaneously rotate all of the sleeve members 14. Similarly, a single motor may be utilized to regulate all of the diaphragm members 30 in the embodiment illustrated in FIG. 6 by a system which interconnects all of the regulating levers 34 such that their positions may be also simultaneously regulated.

The embodiment shown in FIGS. 2 and 3 allows the changing of the intake direction (arrows J or K) of the oxidizer supply to the combustion chamber 4 relative to the general gas flow direction (illustrated by arrow H)

inside the combustion chamber. The oxidizer dwell time can therefore be controlled by this means, and may be used to achieve optimum operation for very different and heretofore nearly incompatible operational modes such as those at full power and near idle.

The embodiment illustrated in FIGS. 4 and 5 benefits from the same regulation method as the embodiment illustrated in FIGS. 2 and 3. Moreover, the asymmetry of the position of the inlet aperture 29 relative to the central axis 16 allows using the kinetic energy of the oxidizer flow fed into the combustion chamber 4 (along arrow M) at relatively high pressure which is the sum of the oxidizer static pressure and the conversion of its kinetic energy into dynamic pressure. In the orientation illustrated in FIG. 5, the kinetic energy of the oxidizer is not utilized and the oxidizer is introduced into the combustion chamber 4 in a direction of arrow N substantially opposite to the direction of the flow of gases within the combustion chamber, illustrated by arrow H. The control of the dwell time of the gases within the combustion chamber is increased by this embodiment over the embodiment illustrated in FIGS. 2 and 3.

The embodiment of the oxidizer intake assembly illustrated in FIG. 6 permits further regulation of the oxidizer flow into the combustion chamber 4. As noted previously, this embodiment may also include the exhaust aperture oriented obliquely to the central axis 16 so as to provide an elongated side 17 of the sleeve member 14.

The foregoing description is provided for illustrative purposes only and should not be construed as in any way limiting this invention, the scope of which is defined solely by the appended claims.

We claim:

1. An oxidizer intake assembly for a gas turbine engine having a wall bounding a combustion chamber wherein burned gases flow from an upstream end toward a downstream exit comprising:

a) a sleeve member defining: an oxidizer intake passage having a central axis extending therethrough; an oxidizer intake aperture communicating with the oxidizer intake passage; and an oxidizer exhaust aperture communicating with the oxidizer intake passage, such that at least one of the inlet aperture and exhaust aperture lie in a plane extending non-perpendicularly to the central axis; and, b) means to rotatably attach the sleeve member to the wall bounding the combustion chamber such that the sleeve member is rotatable about the central axis with respect to the wall, and such that the inlet aperture is located externally of the combustion chamber and the exhaust aperture is located within the combustion chamber.

2. The oxidizer intake assembly of claim 1, wherein the exhaust aperture lies in a plane extending obliquely to the central axis.

3. The oxidizer intake assembly of claim 1, wherein the inlet aperture lies in a plane extending substantially parallel to the central axis.

4. The oxidizer intake assembly of claim 3, wherein the exhaust aperture lies in a plane extending obliquely to the central axis.

5. The oxidizer intake assembly of claim 1, further comprising:

a) a diaphragm member attached to the sleeve member so as to rotate with respect to the sleeve member, the diaphragm member defining a control orifice; and, b) means to rotate the diaphragm member with respect to the sleeve member such that the control orifice may be selectively aligned with the inlet aperture.

6. The oxidizer intake assembly of claim 5, wherein the inlet aperture lies in a plane extending substantially parallel to the central axis.

7. The oxidizer intake assembly of claim 1, wherein the sleeve member has a flange extending outwardly therefrom generally perpendicular to the central axis and wherein the means to rotatably attach the sleeve member to a wall of a combustion chamber comprises:

a) a disc member adapted to slidably engage the flange and adapted to be fixedly attached to one side of the wall bounding the combustion chamber; and, b) a collar member fixedly attached to the sleeve member and adapted to slidably engage an opposite side of the wall bounding the combustion chamber.

8. A combustion chamber for a gas turbine engine comprising:

a) wall members defining the boundaries of the combustion chamber;

b) a plurality of oxidizer intakes passing through the wall members so as to permit oxidizer to pass into the combustion chamber, at least one of the oxidizer intakes comprising:

i) a sleeve member defining: an oxidizer intake passage having a central axis extending therethrough; an oxidizer inlet aperture communicating with the oxidizer intake passage; and an oxidizer exhaust aperture communicating with the oxidizer intake passage, such that at least one of the inlet aperture and exhaust aperture lie in a plane extending non-perpendicularly to the central axis; and, ii) means to rotatably attach the sleeve member to a wall member defining the combustion chamber such that the sleeve member is rotatable about the central axis with respect to the wall member, and such that the inlet aperture is located externally of the combustion chamber and the exhaust aperture is located within the combustion chamber.

9. The combustion chamber of claim 8, wherein the exhaust aperture lies in a plane extending obliquely to the central axis.

10. The combustion chamber of claim 8, wherein the inlet aperture lies in a plane extending substantially parallel to the central axis.

11. The combustion chamber of claim 10, wherein the exhaust aperture lies in a plane extending obliquely to the central axis.

12. The combustion chamber of claim 8, further comprising:

a) a diaphragm member attached to the sleeve member so as to rotate with respect to the sleeve member, the diaphragm member defining a control orifice; and, b) means to rotate the diaphragm member with respect to the sleeve member such that the control orifice may be selectively aligned with the inlet aperture.

13. The combustion chamber of claim 12, wherein the inlet aperture lies in a plane extending substantially parallel to the central axis.

14. The combustion chamber of claim 8, wherein the sleeve member has a flange extending outwardly therefrom generally perpendicular to the central axis and wherein the means to rotatably attach the sleeve member to a wall member of the combustion chamber comprises:

a) a disc member adapted to slidably engage the flange and adapted to be the fixedly attached to one side of a wall member of the combustion chamber; and, b) a collar member fixedly attached to the sleeve member and adapted to slidably engage an opposite side of a wall member of the combustion chamber.

15. The combustion chamber of claim 8, further comprising actuating means interconnecting each of the sleeve members so as to simultaneously pivot all of the sleeve members relative to the combustion chamber wall.

* * * * *